United States Patent [19]

Kuzunuki et al.

[11] 4,411,338

[45] Oct. 25, 1983

[54] APPARATUS FOR CALCULATING ELEVATOR CAGE CALL FORECAST

[75] Inventors: Soshiro Kuzunuki, Katsuta; Kotaro Hirasawa, Hitachi; Takeo Yuminaka; Kanji Yoneda, both of Katsuta, all of Japan

[73] Assignee: Hitachi, Ltd., Tokyo, Japan

[21] Appl. No.: 305,713

[22] Filed: Sep. 25, 1981

[30] Foreign Application Priority Data

Sep. 27, 1980 [JP] Japan ..... 55-135022

[51] Int. Cl.[3] ..... B66B 1/18

[52] U.S. Cl. ..... 187/29 R

[58] Field of Search ..... 187/29

[56] References Cited

U.S. PATENT DOCUMENTS 4,030,572 6/1977 Kaneko et al. ..... 187/29

4,044,860 8/1977 Kaneko et al. ..... 187/29

4,355,705 10/1982 Schröder et al. ..... 187/29

*Primary Examiner*—J. V. Truhe

*Assistant Examiner*—W. E. Duncanson, Jr.

*Attorney, Agent, or Firm*—Antonelli, Terry & Wands

[57] ABSTRACT

In an elevator system in which an elevator car serves a plurality of floors in response to hall calls and cage calls, the number of, for example, up hall calls originated from, for example, the 2nd floor is counted, and the number of cage calls, classified by destination floors, registered in the elevator car after the elevator car has served each of the up hall calls is also counted. The count of the hall calls and the count of the cage calls classified by destination floors are compared with each other, and, on the basis of the result of comparison, the probabilities of origination of cage calls, classified by destination floors, which will be registered in the elevator car after the elevator car has subsequently served a new up hall call which would be originated from the 2nd floor, are calculated for forecasting future cage calls.

9 Claims, 9 Drawing Figures

APPARATUS FOR CALCULATING ELEVATOR CAGE CALL FORECAST

Figure 1:
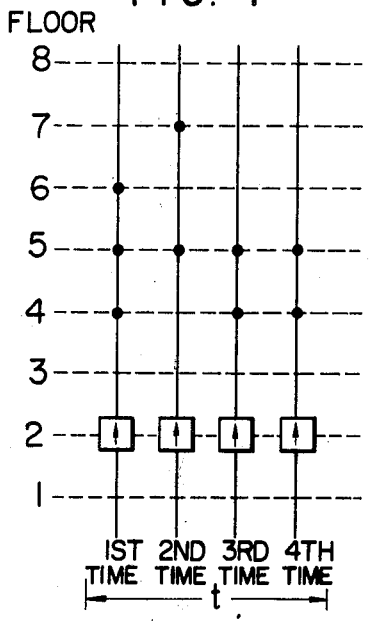

This invention relates to an apparatus for calculating elevator cage call forecast.

As is known well, the operation of an elevator car is controlled on the basis of call information such as a hall call and a cage call and also other information including the car position so that the elevator car can serve the hall and cage calls.

It is also known well that, in an elevator system including a plurality of elevator cars juxtaposed for parallel operation, a method of group control is generally employed in which information including car call information and car position information are processed in a central control apparatus so that the elevator cars can be rationally operated in relation to one another.

It is generally acknowledged that an elevator car or cars can provide service of higher quality when the number of car control information is larger and the accuracy thereof is higher.

Standing on such a view-point, U.S. Pat. No. 4,030,572, granted on June 21, 1977 to the same assignee as the present application, proposes an elevator control apparatus in which a detector for detecting the number of hall waiting passengers is disposed at the hall of each floor so as to make forecasting calculation of cage calls on the basis of the number of hall waiting passensers detected by the detectors. This U.S. Pat. No. 4,030,572 is completely incorporated into the present application as reference. The proposed elevator control apparatus thus realizes a high degree of elevaror car group control capable of calculation of the forecast waiting time for the passengers waiting in the halls for arrival of elevator cars at such floors and capable of rational assignment of hall calls to the elevator cars, while also taking into account cage calls which will be registered in future in the elevator cars.

However, the proposed elevator control apparatus is quite expensive in that it requires a detector for detecting the number of hall waiting passengers and such a detector must be disposed at each of the floors and for each of the elevator cars.

Further, in some cases, the hall waiting passenger detectors cannot be disposed at the elevator halls due to structural and/or design limitations of the elevator halls.

Because of the facts described above, an elevator control apparatus such as that proposed in U.S. Pat. No. 4,030,572, which is capable of attaining a high degree of elevator car group control by the forecast of cage calls, has not yet been put into practical use.

It is therefore a primary object of the present invention to provide an economical and versatile apparatus which can forecast, by calculation, cage calls which will be registered in future in an elevator car, without the necessity for detecting the number of hall waiting passengers.

In accordance with the present invention, in an elevator system including an elevator car of cars for seving a plurality of floors, the number of hall calls generated at a given one of said floors and the number of cage calls, classified by destination floors, generated in an elevator car after the elevator car has served the hall calls are counted so that the probabilities of origination of cage calls, classified by destination floors, which will be registered in the elevator car after the elevator car has subsequently served a new hall call which would be originated from the given one floor, may be calculated on the basis of the counter number of the hall calls and the counted number of the cage calls.

Figure 3:
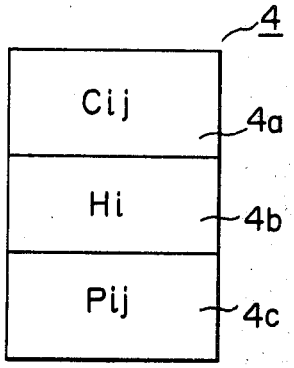
Figure 2:
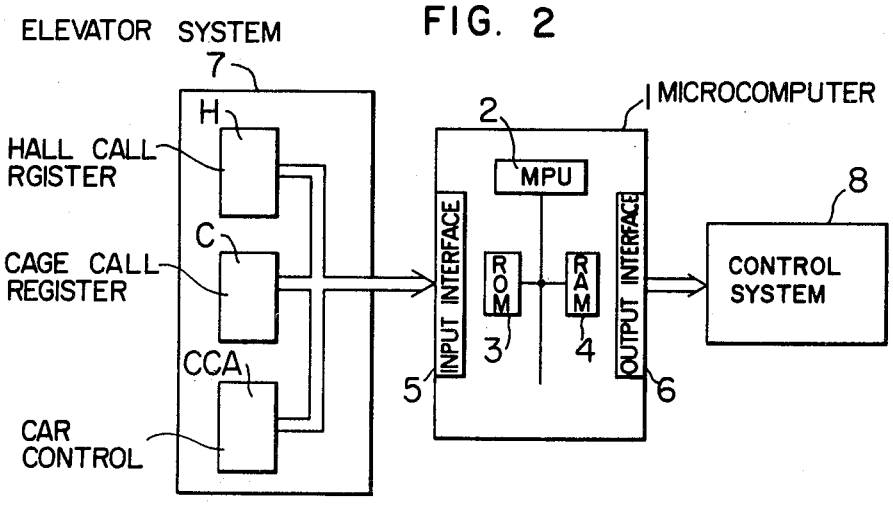
Figure 4:
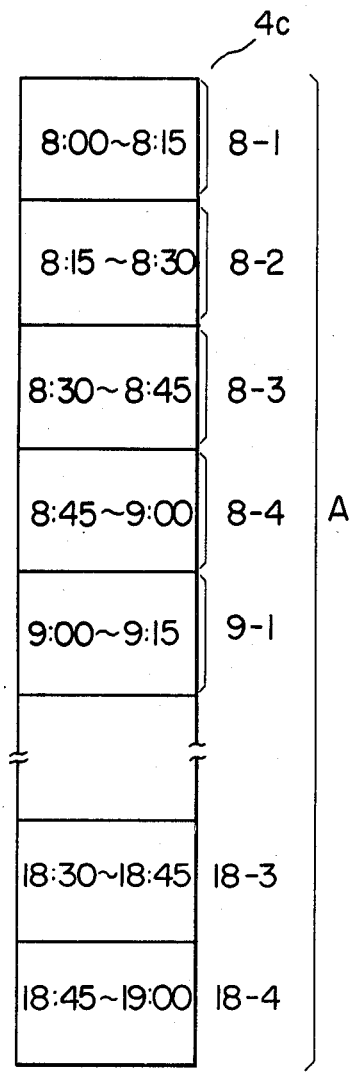
Figure 5:
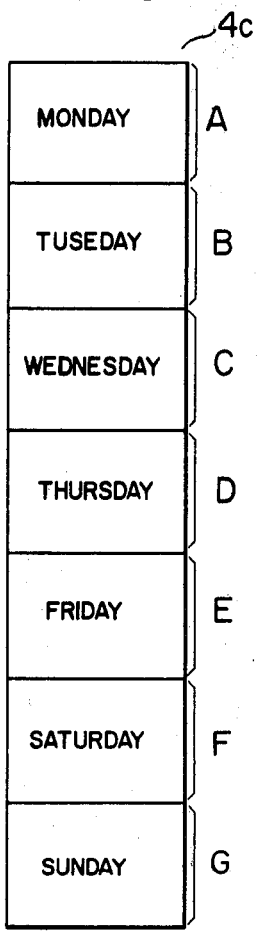
Figure 6:
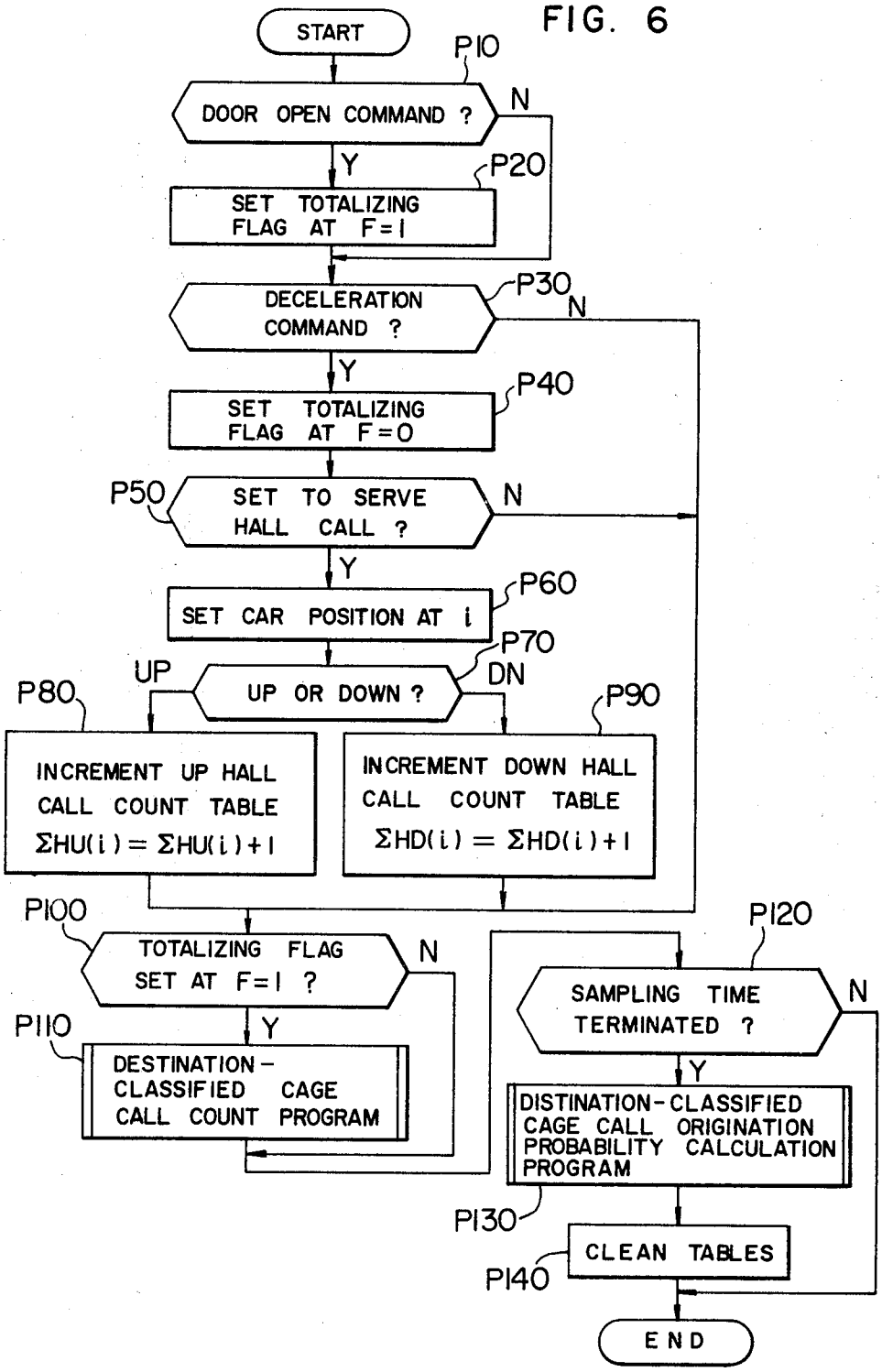
Figure 7:
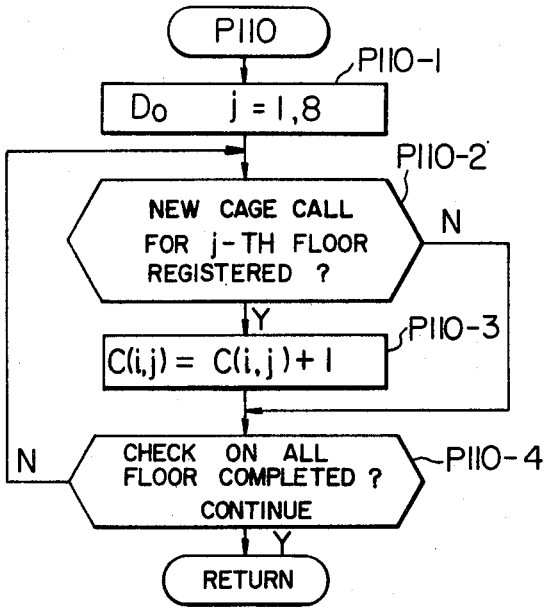
Figure 8:
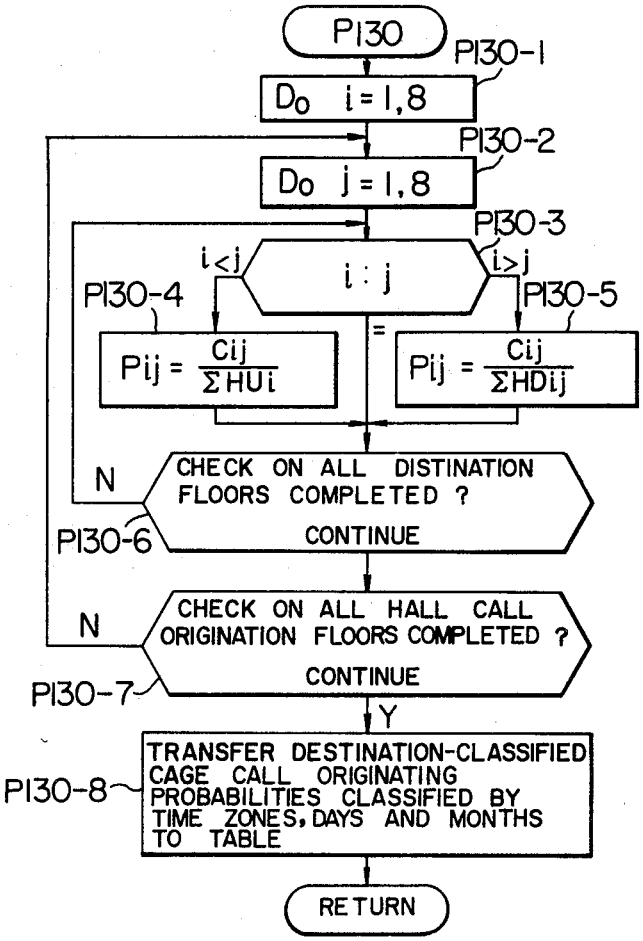
Figure 9:
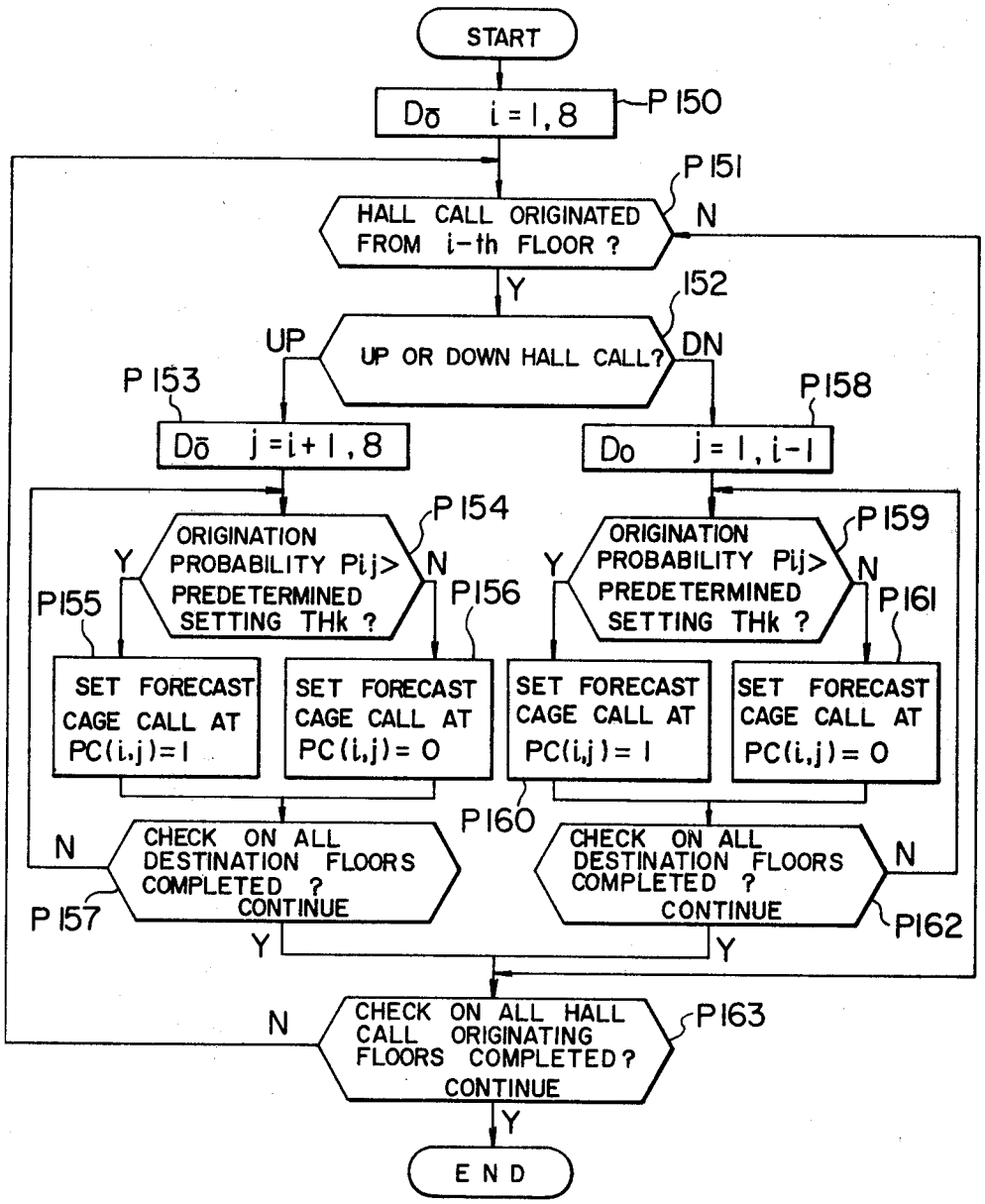

Other objects, features and advantages of the present invention will become more apparent from the following detailed description of a preferred embodiment thereof taken in conjunction with the accompanying drawings, in which:

FIG. 1 shows the operation of an elevator car for illustrating the basic principle of the present invention;

FIGS. 2 to 8 show a preferred embodiment of the cage call forecasting apparatus according to the present invention, in which FIG. 2 being a block diagram showing generally the structure of the cage call forecasting apparatus embodying the present invention, FIG. 3 showing the arrangement of memory tables in the RAM 4 shown in FIG. 2, FIG. 4 showing the constitution of a memory table of probabilities of origination of cage calls classified by destination floors, FIG. 5 showing the constitution of a memory table of probabilities of origination of cage calls classified by destination floors and classified also by the days of a week, FIG. 6 being a flow chart of a main program executed by the microcomputer 1 shown in FIG. 2, FIG. 7 being a flow chart of a sub-program for counting the number of cage calls classified by destination floors, and FIG. 8 being a flow chart of a sub-program for calculating the probabilities of origination of cage calls classified by destination floors; and FIG. 9 is a flow chart of a program for forecasting by calculation the presence or absence of origination of cage calls classified by destination floors.

First of all, the basis principle of the present invention will be explained with reference to FIG. 1 which shows operation of an elevator car.

FIG. 1 illustrates that an elevator car arranged for serving between the 1st floor and the 8th floor of a building has arrived at the 2nd floor to serve an up hall call originated from the 2nd floor.

This 2nd floor will now be specifically noted for the purpose of explanation. Suppose that a succession of four up hall calls have been actually originated from the 2nd floor within a predetermined period of time t, and after the elevator car has served each of these up hall calls, cage calls shown by the black dots have been actually registered in the elevator car. Suppose, as shown in FIG. 1, that cage calls for travel to the 4th, 5th and 6th fllors; the 5th and 6th floors; the 4th and 5th floors; and the 4th and 5th floors are registered after the elevator car has respectively served the 1st, 2nd, 3rd and 4th up hall calls originated from the 2nd floor.

We will now discuss the probabilities Pij of origination of cage calls classified by destination floors within the predetermined period of time t under the situation of elevator car service above described. That is, we will discuss the probability Pij of travel of passengers who ride in the elevator car at the i-th floor and want to be carried to the j-th floor.

In FIG. 1, the probability Pij of travel from the 2nd floor to the 3rd floor is $0/4=0$. The probability Pij of origination of cage calls in each of all the probable cases can be similarly calculated as follows:

$$\left.\begin{aligned} P_{23} &= 0/4 = 0 \\ P_{24} &= 3/4 = 0.75 \\ P_{25} &= 4/4 = 1.0 \\ P_{26} &= 1/4 = 0.25 \\ P_{27} &= 1/4 = 0.25 \\ P_{28} &= 0/4 = 0 \end{aligned}\right\} \quad (1)$$

It will be seen that the probability $P_{25}$ of travel from the 2nd floor to the 5th floor is 1.0, and this proves that the 2nd and 5th floors are intimately related with each other. The probability $P_{23}$ of travel from the 2nd floor to the 3rd floor is zero, and the probability $P_{28}$ of travel from the 2nd floor to the 8th floor is also zero. This proves that the 2nd floor has no substantial concern with the 3rd and 3th fllors from the aspect of, for example, business.

It will thus be seen that the probabilities Pij of origination of cage calls classified by destination fllors can be determined by counting the number of past hall calls and cage calls served by the elevator car and calculating similarly to the equations (1). Such traffic information can be utilized as elevator control data. For example, such traffic information can be utilized as the forecast cage calls disclosed in the above-mentioned U.S. Pat. No. 4,030,572.

The general expression for calculating the probabilities Pij of origination of cage calls classified by destination floors is as follows:

$$Pij = \frac{\Sigma C_{ij}}{\Sigma Hi} \quad (2)$$

where ΣCij represents the total number of cage calls registered by passengers who ride in the elevator car at the i-th floor and want to travel to the j-th floor within the predetermined period of time t, and ΣHi represents the total number of hall calls originated at the i-th floor within the predetermined period of time t. It is apparent that Hi represents the total number of up hall calls when i<j and the total number of down hall calls when i>j.

TABLE 1

| | | ΣHi | Destination Floor (j) | | | | | | | | ΣHi |
|---|---|---|---|---|---|---|---|---|---|---|---|
| | | i > j | 1 | 2 | 3 | 4 | 5 | 6 | 7 | 8 | i < j |
| Hall call | 1 | 0 | | 3 | 2 | 4 | 5 | 3 | 2 | 5 | 20 |
| originating | 2 | 4 | 4 | | 1 | 0 | 2 | 4 | 2 | 1 | 8 |
| floor (i) | 3 | 5 | 4 | 2 | | 0 | 1 | 3 | 2 | 2 | 7 |
| | 4 | 3 | 3 | 1 | 1 | | 2 | 0 | 0 | 0 | 2 |
| | 5 | 9 | 6 | 2 | 0 | 3 | | 2 | 3 | 2 | 5 |
| | 6 | 5 | 2 | 3 | 2 | 0 | 2 | | 4 | 3 | 6 |
| | 7 | 9 | 4 | 1 | 1 | 0 | 2 | 4 | | 3 | 3 |
| | 8 | 11 | 5 | 2 | 2 | 0 | 1 | 3 | 2 | | 0 |

TABLE 2

| | | Destination Floor (j) | | | | | | | |
|---|---|---|---|---|---|---|---|---|---|
| | | 1 | 2 | 3 | 4 | 5 | 6 | 7 | 8 |
| Hall | 1 | | 0.15 | 0.1 | 0.2 | 0.25 | 0.15 | 0.1 | 0.25 |
| call | 2 | 1.0 | | 0.125 | 0 | 0.25 | 0.5 | 0.25 | 0.125 |
| origi- | 3 | 0.8 | 0.4 | | 0 | 0.143 | 0.429 | 0.286 | 0.286 |
| nating | 4 | 1.0 | 0.333 | 0.333 | | 1.0 | 0 | 0 | 0 |
| floor (i) | 5 | 0.667 | 0.182 | 0.182 | 0.273 | | 0.25 | 0.6 | 0.25 |
| | 6 | 0.4 | 0.6 | 0.6 | 0 | 0.4 | | 0.667 | 0.5 |
| | 7 | 0.444 | 0.111 | 0.111 | 0 | 0.222 | 0.444 | | 1.0 |
| | 8 | 0.455 | 0.182 | 0.182 | 0 | 0.090 | 0.273 | 0.182 | |

Table 1 shows an example of the results of counting of the number Cij of registered cage calls classified by destination floors and the number ΣHi of originated hall calls within the predetermined period of time, and Table 2 shows the probabilities Pij of origination of cage calls calssified by destination floors, calculated on the basis of the data shown in Table 1. In Table 2, the probability Pij of origination of cage calls for travel from the 7th floor to the 8th floor is 1.0, and the probability Pij of origination of cage calls for travel from the 2nd floor to the 1st floor is also 1.0. This is because the 1st and 8th floors are the terminal floors, and a cage call is necessarily registered in the elevator car for travel from the 8th floor to the 8th floor or travel from the 2nd floor to the 1st floor. The probability Pij of origination of cage calls for travel from the 4th floor to the 1st floor is 1.0. This indicates that a cage call for travel from the 4th floor to the 1st floor is similarly necessarily registered in the elevator car. On the other hand, the probability Pij of origination of cage calls for travel from the 4th floor to the 6th floor is zero which is the minimum. This indicates that there is substantially no intimate relation therebetween from the aspect of business.

The probabilities Pij of orignation of cage calls classified by destination floors, described above, can be easily calculated by means of an LSI element capable of arithmetic processing of data such as a microcomputer.

In an office building, for example, there are generally some kinds of business relations among the specific floors, and the destination floors are fixed in many cases. Further, there are specific floors such as the restaurant floor and the lobby floor in the building. Cage calls for travel to the restaurant floor are necessarily registered in the lunch time, and cage calls for travel to the lobby floor are necessarily registered in the office closing time. Thus, the traffic flow is fixed depending on the character of a building. Utilizing the above fact, the present invention calculates the probabilities Pij of origination of cage calls classified by destination floors. When the probability Pij of origination of cage calls for travel between the i-th floor and the j-th floor is proved to be high, this indicates that is an intimate relationship between thse floors. Therefore, by the use of such data, cage calls that will be registered in future can be forecast by calculation, and, also, the arrival time of the elevator car at a specific floor can be forecast by calculation. Further, by printing out and analyzing the data, the traffic flow in the building can be grasped.

FIG. 2 is a block diagram showing the structure of a preferred embodiment of the cage call forecast calculating apparatus according to the present invention. Referring to FIG. 2, a microcomputer 1 is composed of a microprocessor unit (hereinafter abbreviated as an MPU) 2, a read-only memory (hereinafter abbreviated as an ROM) 3, a random access memory (hereinafter abbreviated as an RAM) 4, an input interface 5 and an output interface 6.

An elevator system 7, which is known well in the art, includes a hall call register H disposed at each of the floors and manipulated by a passenger who wants to travel in the up or down direction from that floor by the elevator car, a cage call register C disposed in the elevator car and manipulated by a passenger who designates his destination floor, and an elevator car control unit CCA for controlling the operation of the elevator car.

The microcomputer 1 receives necessary information (such as hall call information, cage call information, car position information and door open-close command information) from the elevator system 7 through the input interface 5, and, after calculating the forecast or future cage calls, applies the result of calculation to a group control system or elevator car control system 8.

For the above purpose, the ROM 3 in the microcomputer 1 stores a calculation program for cage call forecast and any other necessary data, and the RAM 4 stores memory tables such as those shown in Tables 1 and 2 in an arrangement as shown in FIG. 3. Referring to FIG. 3, a table 4*a* of the counts Cij of cage calls classified by destination floors, a table 4*b* of the counts Hi of hall calls classified by hall-call originating floors, and a table 4*c* of the probabilities Pij of origination of cage calls classified by destination floors are stored in the RAM 4 in the above order. In the embodiment, a day is divided into a plurality of time zones, and the cage call origination probabilities Pij in the individual time zones are stored in the table 4C, as will be described presently with reference to FIG. 4.

Referring to FIG. 4, the first block 8-1 in the table 4C includes data sampled during a period of 15 minutes from, for example, the time 8:00 to the time 8:15. Thus, as seen in FIG. 4, data sampled during a period of 10 hours ranging from the time 8:00 to the time 19:00 at time intervals of 15 minutes are stored as respective blocks 8-1, 8-2, 8-3, 8-4, 9-1, . . . , 18-3 and 18-4. Therefore, the table 4C tabulates the results of calculation of the probabilities Pij of origination of cage calls classified by destination floors, in the divided time zones.

The period of time is limited to within the range of from 8:00 to 19:00 for the purpose of minimizing the capacity of the RAM 4. Generally, the greater proportion of traffic demand appears within the period of 10 hours between the morning and the evening, and, therefore, calculation of the probabilities Pij within the limited period of 10 hours is considerably effective, although not fully satisfactory. It is needless to mention that the sampling may be made throughout the day.

Further, in order to minimize the capacity of the RAM 4, the sampling may be made at relatively short time intervals in the time zones in which there is much traffic deamnd, and it may be made at relatively long time intervals in the time zones in which there is less traffic demand. Data may be classified by the days of a week. Referring to FIG. 5, each of the blocks A, B, C, D, E, F and G corresponds to the blocks 8-1 to 18-4 in the table 4C shown in FIG. 4. More precisely, data sampled in the individual days of a week are stored in the blocks A, B, C, D, E, F and G respectively. Further, although not illustrated, data sampled in the respective months of a year may be similarly stored. When the data classified by the days of a week or by the months of a year are stored in the RAM 4, a large capacity is inevitably required for the RAM 4. To avoid the increase in the capacity of the RAM 4, it is desirable to additionally provide an auxiliary memory such as a magnetic tape cassette or a floppy disk. This method is effectively applied to a building in which the traffic demand varies depending on the days of a week or months of a year.

The above description has clarified the arrangement of the memory tables in the RAM 4. Description will now be directed to the procedure for calculation of the probabilities Pij of origination of cage calls classified by destination floors. That is, description will be directed to a program stored in the ROM 3 to be executed by the microcomputer 1.

FIG. 6 is a flow chart of a preferred form of a main program executed by the microcomputer 1 to calculate the probabilities Pij of origination of cage calls classified by destination floors. Referring to FIG. 6, steps P10 to P40 are executed to detect the period of time from a door-open command to a deceleration command, that is, the period of time time the time at which the door of the elevator car is opened at a specific floor to accommodate a hall waiting passenger or passengers to the time at which the elevator car begins to decelerate next. During this period of time, the passengers ridden in the elevator car at the specific floor register cage calls. During this detected period of time a cage call totalizing flag F is set at F="1". Otherwise, the flag F is set at F="0".

Then, in step P50, whether or not the elevator car should be stopped to serve a hall call is checked, and when the result of checking proves that the elevator car should be stopped to serve the hall call, the elevator car position is set at i in step P60 so as to determine the location of the car position data in the specific memory table. In step P70, the direction of movement of the elevator car is detected, and, the up hall call count table or the down hall call count table is incremented in step P80 or P90 depending on the direction of movement of the elevator car.

In step P100, whether or not the cage call totalizing flag F described in step P20 is set at F="1" is checked, and, when the result of checking proves that F="1", a sub-program for counting cage calls classified by destination floors is executed in step P110. Then, completion of the cage call totalization continued for a predetermined period of time, that is, termination of the predetermined sampling period of time is judged in step P120. In step P130, a sub-program for calculating the probabilities Pij of origination of cage calls classified by destination floors is executed, and, in step P140, the memory tables shown in FIG. 3 are cleared so as to receive data sampled in the next sampling period of time. The step P140 completes the main program shown in FIG. 6. This main program is executed at intervals of the predetermined period of time.

FIG. 7 is a flow chart of an embodiment of the step P110 (the sub-program for counting cage calls classified by destination floors) in the main program shown in FIG. 6, and FIG. 8 is a flow chart of an embodiment of the step P130 (the sub-program for calculating the probabilities Pij of origination of cage calls classified by destination floors) in the main program shown in FIG. 6.

In the sub-program shown in FIG. 7, new cage calls registered at the i-th floor served by the elevator car are counted for each of the destination floors. In step P110-2, judgment is made as to whether or not a new cage call for travel from the i-th floor to the j-th floor has been registered. When the result of judgment proves that such a new cage call has been registered, step P110-3 is executed in which the table C(i, j) of the counts of cage calls classified by destination floors is incremented. The above progress is executed for each j-th floor, from the 1st floor to the 8th floor, and, when completion of the processing on all the floors is detected in step P110-4, this sub-program P110 terminates.

In the sub-program shown in FIG. 8, the probabilities Pij of origination of cage calls classified by destination floors, given by the equation (2), are calculated. More precisely, the probability Pij of origination of a cage call for travel from the i-th floor to the j-th floor is calculated. This i-th floor represents each of the hall call originating floors (the 1st floor to the 8th floor), and the j-th floor represents each of the destination floors (the 1st floor to the 8th floor). Thus, the cage call origination probability Pij is calculated for each of the hall call originating floors. In step P130-3, the ordinal of the i-th floor from which a hall call has been originated is compared with that of the j-th floor which is the destination floor. When the result of comparison proves that $i<j$, step P130-4 is executed in which the probability Pij of origination of up cage calls for travel from the i-th floor to the j-th floor is calculated. On the other hand, when the result of comparison proves that $i>j$, step P130-5 is executed in which the probability Pij of origination of down cage calls for travel from the i-th floor to the j-th floor is calculated. The relation $i=j$ never holds, and no calculation is done.

By the execution of the above steps, all of the probabilities Pij of origination of cage calls classified by destination floors, shown in Table 2, can be calculated.

In step P130-8, the probabilities Pij of origination of cage calls classified by destination floors, calculated by the above steps, are classified by the time zones of a day, by the days of a week and by the months of a year and are transferred to the RAM 4 to be stored in the corresponding memory table. In this manner, the tables of the cage call origination probabilities Pij classified by the time zones of a day, by the days of a week and by the months of a year, as shown in FIGS. 4 and 5 can be prepared.

As aforementioned, according to this embodiment may provide, in the first place, the probabilities of origination of cage calls calssified by destination floors, as new control information to be utilized for the elevator car control. The probability of origination of cage calls is, in other words, the forecast value of generation of cage calls. Therefore, as described in detail in the above-mentioned U.S. Pat. No. 4,030,572, the forecast waiting time can be calculated on the basis of the cage call forecast in a manner as will be described now. Suppose, for example, that a period of time of 10 seconds is required for the elevator car to stay at a floor to serve a corresponding cage call. Then, the value obtained by multiplying 10 seconds by the cage call origination probability Pij is calculated to be the period of time required for the elevator car to stay at the floor corresponding to the forecast cage call. In the forecast of the presence or absence of origination of a cage call, judgment may be made as to whether the cage call origination probability Pij is more than a predetermined setting, as described later with reference to FIG. 9. Thus, the cage call origination probabilities Pij according to the embodiment can be utilized for the forecast of origination of cage calls, the calculation of forecast waiting times, etc., thereby satisfying the demand for better elevator service.

In the second place, any especial units are unnecessary because future cage calls can be forecast on the basis of existing information including cage call information, hall call information and car control information. For example, the control of the elevator car taking into account the forecast cage calls described in the above-mentioned U.S. Pat. No. 4,030,572 is made possible without requiring the provision of the detectors detecting the number of hall waiting passengers.

Thirdly, the accuracy of elevator control can be improved because future cage calls can be forecast by calculation to meet the ever-changing traffic demand and also the traffic flow varying depending on the time zone.

FIG. 9 is a flow chart of a program for forecasting the presence or absence of origination of a cage call on the basis of the aforementioned probabilities Pij of origination of cage calls classified by destination floors. As shown in FIG. 9, judgment is made in step P151 as to whether or not a hall call is originated from the i-th floor. When the result of judgment is "Yes", judgment is made in step P152 as to whether this hall call is an up hall call or a down hall call. When it is an up hall call, judgment is made in step P154 as to whether the cage call origination probability Pij for each of the destination floors ($j=i+1$ to 8) is more than a predetermined setting THk. When the result of judgment for the j-th floor proves that $Pij \geqq THk$, the forecast cage call PC(i, j) for travel to the j-th floor is set at "1" in step P155, while, when the result of judgment proves that $Pij<THk$, the forecast cage call PC(i, j) for travel to the j-th floor is set at "0" in step P156. In the case of a down hall call, steps P159 to P161 are similarly executed for each of the destination floors ($j=i-1$ to 1). This predetermined setting THk may be selected to be a value corresponding to the value 0.6 to 1.0 of the cage call origination probability depending on the purpose of utilization of forecast cage calls.

By the execution of the program shown in FIG. 9, it is possible to immediately forecast the presence or absence of cage calls that will be registered in the elevator car which serves a floor from which a hall call is originated.

What we claim is:

1. An apparatus for calculating cage call foreast of an elevator car in an elevator system including cage call registering means disposed in said elevator car for specifying destination floors among a plurality of floors to be served by said elevator car, hall call registering means disposed at the elevator hall of each of said plurality of floors for calling said elevator car thereto, and means for operating said elevator car so that said elevator car can serve said plurality of floors in response to cage calls registered by said cage call registering means and hall calls registered by said hall call registering means, said apparatus comprising:

hall call counting means for counting the number of hall calls originated from a given one of said floors;

cage call counting means for counting the number of cage calls, classified by destination floors, registered in the elevator car after the elevator car has served each of the hall calls originated from said given one floor; and cage call origination probability calculating means for calculating the probabilities of origination of cage calls, classified by destination floors, which will be registered in said elevator car after said elevator car has subsequently served a new hall call which would be originated from said given one floor, on the basis of the number of the hall calls counted by said hall call counting means and the number of the cage calls, classified by destination floors, counted by said cage call counting means.

2. An apparatus as claimed in claim 1, wherein said hall call counting means includes means for counting the number of hall calls originated from each of said plural floors, wherein said cage call counting means includes means for counting the number of cage calls for each of destination floors, and wherein said cage call origination probability calculating means calculates the probability of origination of cage calls, classified by designation floors, for each of said plural floors, on the basis of the count of hall calls originated from each of said plural floors and the count of cage calls registered in said elevator car at each of said plural floors.

3. An apparatus as claimed in claim 1, wherein said hall call counting means counts the number of said hall calls classified by up and down directions, wehrein said cage call counting means counts the number of said cage calls classified by up and down directions as well as by destination floors, and said cage call origination probability calculating means calculates said probability of origination of cage calls classified by up and down directions.

4. An apparatus as claimed in claim 1, wherein said cage call origination probability calculating means calculates said probability of origination of cage calls on the basis of the ratio between the counted number of said cage calls and the counted number of said hall calls.

5. An apparatus as claimed in claim 1, wherein said cage call origination probability calculating means calculates said probability of origination of cage calls on the basis of the counted number of said cage calls counted within a predetermined period of time and the counted number of said hall calls.

6. An apparatus as claimed in claim 1, wherein a part of day is divided into a plurality of time zones, and said cage call origination probability calculating means calculates said cage call origination probabilities classified by the time zones.

7. An apparatus as claimed in claim 1, wherein said cage call origination probability calculating means calculates said cage call origination probabilities classified by the days of a week.

8. An apparatus as claimed in claim 1, wherein said cage call counting means counts the number of cage calls, classified by destination floors, originated after the door of said elevator car has been opened at said given one floor but before said elevator car is decelerated toward a next destination floor to be served.

9. An apparatus as claimed in claim 1, wherein means are provided for comparing each of said cage call origination probabilities classified by destination floors with a predetermined setting and forecasting the presence or absence of cage calls, classified by destination floors, which will be registered in said elevator car at said given one floor.

* * * * *